US006473117B1

(12) United States Patent
Iba

(10) Patent No.: US 6,473,117 B1
(45) Date of Patent: Oct. 29, 2002

(54) DRIVING METHOD FOR LIQUID CRYSTAL DEVICE

(75) Inventor: Jun Iba, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 27 days.

(21) Appl. No.: 09/641,978

(22) Filed: Aug. 21, 2000

(30) Foreign Application Priority Data

Aug. 24, 1999 (JP) ..... 11-236326
Aug. 23, 2000 (JP) ..... 2000-252538

(51) Int. Cl.[7] ..... G09G 3/36
(52) U.S. Cl. ..... 348/87; 345/96; 345/98
(58) Field of Search ..... 345/87, 88, 89, 345/94, 95, 96, 98, 99, 100; 349/33, 37; 348/790, 792

(56) References Cited

U.S. PATENT DOCUMENTS 5,748,164 A * 5/1998 Handschy et al. ..... 345/89
5,995,076 A 11/1999 Tsuboyama et al. ..... 345/97
6,028,579 A 2/2000 Tsuboyama et al. ..... 345/97

* cited by examiner

*Primary Examiner*—Dennis-Doon Chow
(74) *Attorney, Agent, or Firm*—Fitzpatrick, Cella, Harper & Scinto

(57) ABSTRACT

An active matrix-type liquid crystal panel is driven for a motion picture display in a succession of frame periods to provide an improved motion picture quality without causing a lowering in luminance or contrast, or a display irregularity over the panel due to a signal transmission delay along the panel electrodes. In the driving method, each frame period is divided into a plurality of sub-frame periods including at least one preceding sub-frame period and a final sub-frame period so that said at least one preceding sub-frame period provides a total period which is shorter than the final sub-frame period; the active elements along the rows of pixels are sequentially selected row by row at respective selection periods in each sub-frame period; and the liquid crystal at each pixel is supplied with a voltage in a selection period of each preceding sub-frame period which is lower than a voltage applied to the liquid crystal at the pixel in the final sub-final period.

14 Claims, 9 Drawing Sheets

DRIVING METHOD FOR LIQUID CRYSTAL DEVICE

FIELD OF THE INVENTION AND RELATED ART

The present invention relates to a driving method for a liquid crystal device for use as a light valve in a flat panel display, a projection display, a printer, etc.

Various liquid crystal materials have been used in liquid crystal devices, such as nematic liquid crystals, smectic liquid crystals, polymer dispersion-type liquid crystals. Among these, a liquid crystal material classified under a nematic liquid crystal has a long response time of 50 to several hundred msec, and the liquid crystal response is not completed in one frame period (16.7 msec, 60 Hz), so that a picture flow is caused in the case of a motion picture display to result in a poor motion picture quality, thus being unsuitable for motion picture display.

On the other hand, a chiral smectic liquid crystal having a spontaneous polarization has a shorter response time which is nearly one thousandth of that of a nematic liquid crystal, thus allowing a response in one frame period and being considered as suitable for motion picture display.

In recent years, however, it has been clarified that motion picture quality cannot be improved only by a short response time. For example, it has been reported that a continuous lighting-type display device (hold-type display device), such as a liquid crystal device, provides an inferior motion picture quality in principle compared with a pulse lighting-type display device (non-hold-type display device), such as a CRT (cathode ray tube), in "Shingaku Giho EID 96–4 (1996), p. 16".

The above report also describes that the motion picture quality of a hold-type display device can be improved by providing a partially non-display period in one frame period which has been conventionally fully used as a display period. The motion picture quality can alo be improved to some extent by adopting a higher display frame frequency of, e.g., 120 Hz (frame period)=8.35 msec), than 60 Hz (16.7 msec).

However, of the above-mentioned display methods, the method of adopting a partially non-display period is accompanied with a difficulty of resulting in an effectively dark display due to a lowering in time-integrated luminance especially in the case where the non-display period is increased.

On the other hand, the method of relying on a higher frame display speed is liable to suffer from a signal transmission delay along panel electrodes and a display irregularity over a panel due to an increased drive frequency.

SUMMARY OF THE INVENTION

A principal object of the present invention is to provide a driving method for a liquid crystal device capable of improving the motion picture quality without lowering the luminance or contrast or without causing a signal transmission delay along the electrodes or display irregularity.

According to the present invention, there is provided a driving method for a liquid crystal device of the type comprising: a pair of substrates, a liquid crystal disposed between the substrates so as to form a matrix of pixels arranged in a plurality of rows and a plurality of columns, an electrode matrix for applying voltages to the liquid crystal at respective pixels, and a plurality of active elements each provided to a pixel for supplying a voltage applied to the liquid crystal at the pixel; the driving method comprising driving the liquid crystal device in a succession of frame periods, wherein each frame period is divided into a plurality (n) of sub-frame periods including at least one (n−1) preceding sub-frame period and a final sub-frame period so that said at least one (n−1) preceding sub-frame period provides a total period which is shorter than the final sub-frame period, the active elements along the rows of pixels are sequentially selected row by row at respective selection periods in each sub-frame period, and the liquid crystal at each pixel is supplied with a voltage in each preceding sub-frame period which is lower than a voltage applied to the liquid crystal at the pixel in the final sub-frame period.

Thus, in the present invention, the total period of the preceding at least one sub-frame period is shortened and an intermediate state between the display and non-display states is displayed during the preceding sub-frame period(s) to improve the motion picture quality while suppressing a lowering in contrast, and the final sub-frame period is made longer to suppress the adverse effect accompanying the signal transmission delay along the panel electrodes.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
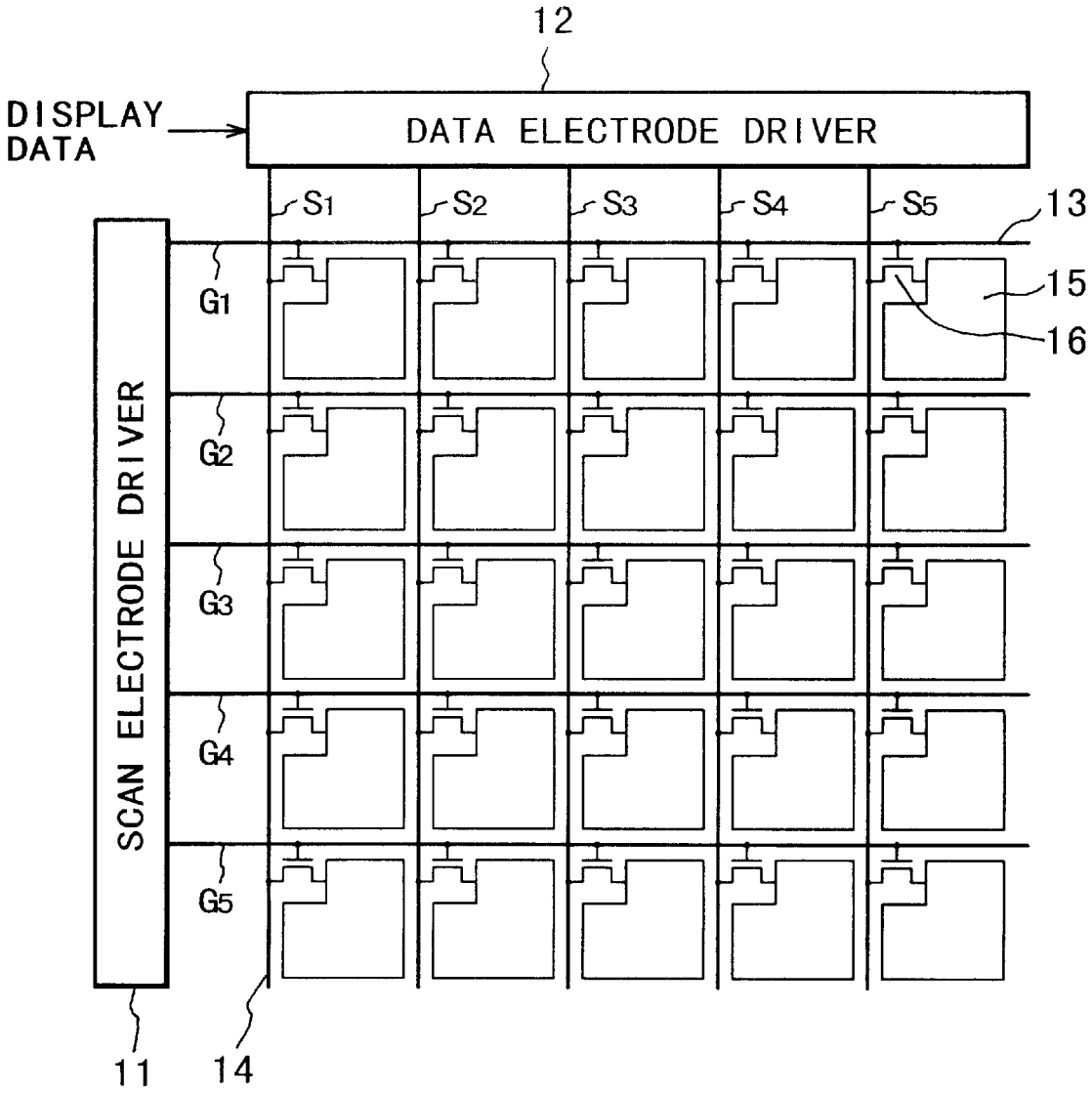
FIG. 1 is a schematic plan view of an active matrix substrate of an example of liquid crystal device to be driven by the method of the invention.

First of all, an example of liquid crystal device to be driven by the driving method according to the present invention will be described. FIG. 1 is a schematic plan view of an active matrix substrate included in such a liquid crystal device of the active matrix type wherein each pixel is provided with an active element. Referring to FIG. 1, the liquid crystal device includes a scanning signal line (gate line) driver 11, a data signal line (source line) driver 12, scanning signal lines 13 (G1–G5), data signal lines 14 (S1–S5), pixel electrodes 15, and TFTs (thin film transistors) 16. In this embodiment, each pixel is provided with a TFT 16 having an on-resistance of ca. 10 M.ohm as an active element (or a switching device). FIG. 1 illustrates only 5×5 pixels for convenience while a larger number of pixels are included actually.

The liquid crystal device having the organization shown in FIG. 1 may be driven by sequentially applying a scanning signal to the gate electrodes of TFTs 16 via the scanning signal liens 13 row by row at a prescribed time for each row of TFTs on an associated scanning signal line 13, and applying data signals corresponding to given display data to the source electrodes of the TFTs 16 in synchronism with each scanning signal and then to the pixel electrodes 15 connected to the drain electrodes of the TFTs 16 on an associated row of the pixels selected by the scanning signal.

Figure 2:
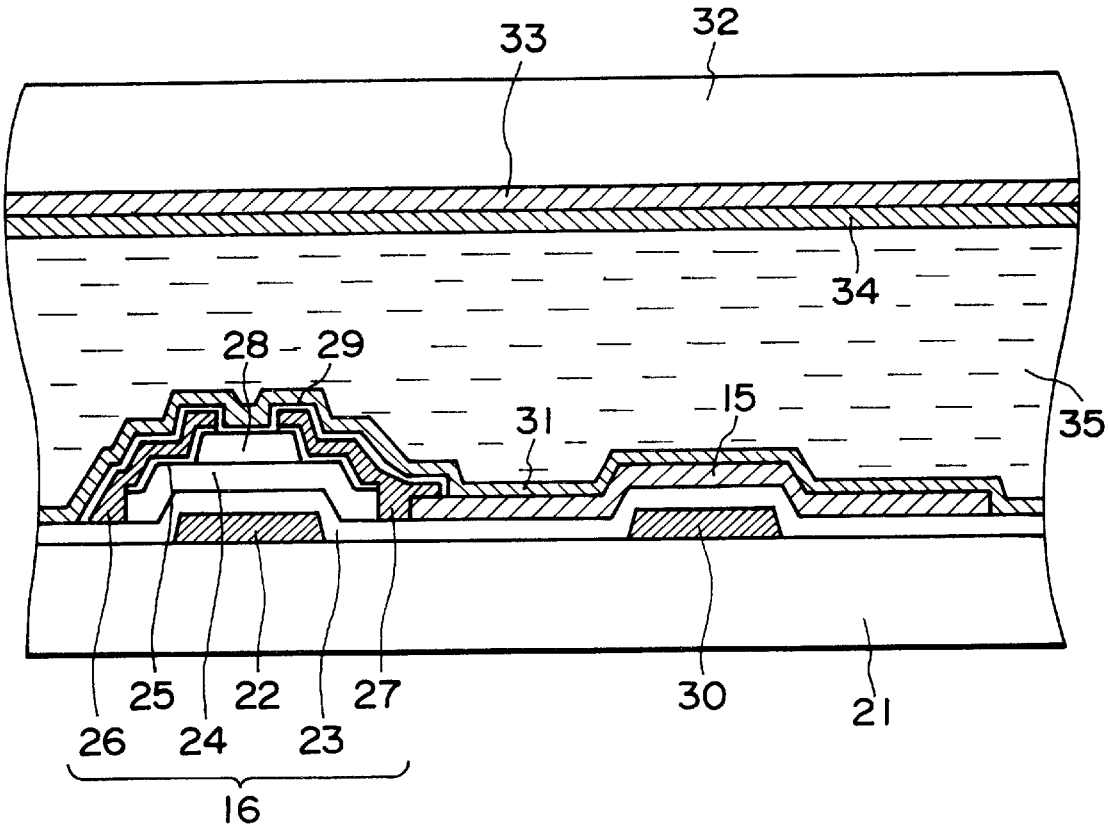
FIG. 2 is a schematic sectional view for illustrating an organization of one pixel portion in the liquid crystal device.

FIG. 2 is a sectional view showing an organization of one pixel of such a liquid crystal device. Referring to FIG. 2, the liquid crystal device includes a pair of substrates 21 and 32, and each pixel is provided with a TFT 16 including a gate electrode 22, a gate insulating film 23, a semiconductor layer 24, an ohmic contact layer 25, a source electrode 26, a drain electrode 27, an insulating layer 28, and a passivation film 29, and includes a pixel electrode 15, a common electrode 33, alignment films (alignment control films) 31 and 34, a liquid crystal 35 disposed between the alignment films, and a retention capacitor electrode 30 below the insulating film 23.

In the liquid crystal device shown in FIG. 2, the substrate 21 may ordinarily comprise a transparent sheet of glass, plastic, etc. in the case of a transmission type, and can occasionally comprise an opaque sheet of, e.g., a silicon substrate in the case of a reflection type. The substrate 32 on the opposite side may ordinary comprise a transparent sheet as mentioned above. The pixel electrode 15 and the common electrode 33 may both comprise a transparent conductor, such as ITO (indium tin oxide), in the case of a transmission-type device, but the pixel electrode 15 can comprise a reflective metal so as to also function as a reflection plate in the case of a reflection-type device. The semiconductor layer 24 may generally comprise amorphous (a-)Si and may also preferably comprise polycrystalline (p-)Si. The ohmic contact layer 25 may for example comprise an $n^+$ a-Si layer. The gate insulating film 23 may comprise silicon nitride ($SiN^X$), etc. The gate electrode 22, source electrode 26, dlain electrode 27, retention capacitor electrode 30 and conductors, may generally comprise a metal, such as Al. The retention capacitor electrode 30 can comprise a transparent conductor, such as ITO, in case where it has a relatively large area. The insulating layer 28 and the passivation film 29 may preferably comprise an insulating film, such as that of silicon nitride. The alignment films 31 and 34 may comprise a material appropriately selected depending on a liquid crystal used, and may comprise a rubbed film of a polymer, such as polyimide, in this embodiment of using a smectic liquid crystal.

The above-mentioned liquid crystal device may be sandwiched between a pair of polarizers disposed outside the substrates 21 and 32, respectively, in the case of a transmission-type device, and may be provided with one polarizer disposed on either one of the substrates 21 and 32, generally the substrate 32, in the case of a reflection-type device.

Figure 3:
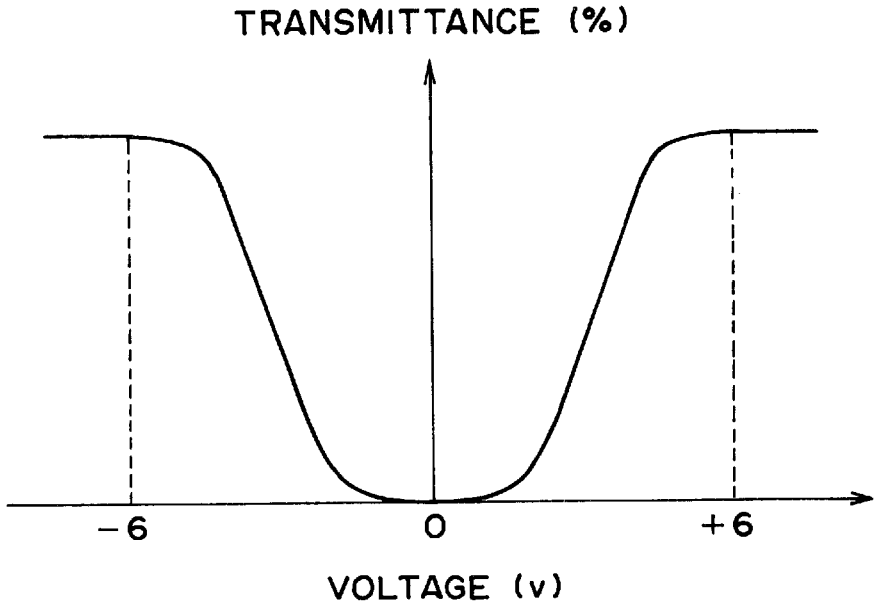
FIG. 3 is a diagram showing a V-T characteristic of an example of liquid crystal device to be driven by the method of the invention.

The liquid crystal used in the liquid crystal device of this embodiment may preferably comprise a chiral smectic liquid crystal having a spontaneous polarization, examples of which may include (anti-)ferroelectric liquid crystals. It is preferred to use a threshold-less anti-ferroelectric liquid crystal (TAFLC) to organique a liquid crystal device having a voltage-transmittance characteristic (V-T characteristic) as shown in FIG. 3, a so-called V-character responsiveness showing an identical transmittance in response to application of both positive and negative voltages giving an identical absolute value. It is also possible to use an anti-ferroelectric liquid crystal, a high-speed twisted nematic liquid crystal, etc., capable of completing the liquid crystal response in one frame period at the latest in this embodiment. Herein, the liquid crystal response means a change from a prescribed dark state (non-transmissive state) to a prescribed bright state (a state giving a prescribed level of light transmittance).

In a liquid crystal device exhibiting a V-character responsiveness as shown in FIG. 3, the liquid crystal shows a first transmittance (e.g., substantially non-transmissive state in FIG. 3) under no voltage application, and a second transmittance (e.g., light-transmissive state in FIG. 3) under application of prescribed voltages ±Vp, and the transmittance through the liquid crystal changes continuously, i.e., gradually without causing a steep transmittance in response to a voltage change, between the first transmittance and the second transmittance depending on the voltage applied thereto. Accordingly, if the polarizer(s) is (are) disposed so that the first transmittance correspond to the darkest state and the second transmittance corresponds to the brightest state as shown in FIG. 3, it becomes possible to effect a gradational display giving various transmittances instead of a binary display giving substantially two transmittances, in response to variously changing voltages.

In the above embodiment, a TFT which is a three-terminal device is used as an active element but a two terminal device, such as an MIM device, can also be used instead thereof.

Now, some embodiments of the driving method according to the present invention for driving, e.g., a liquid crystal device showing a V-character responsiveness of FIG. 3 will be described below.

First Embodiment

Figure 4:
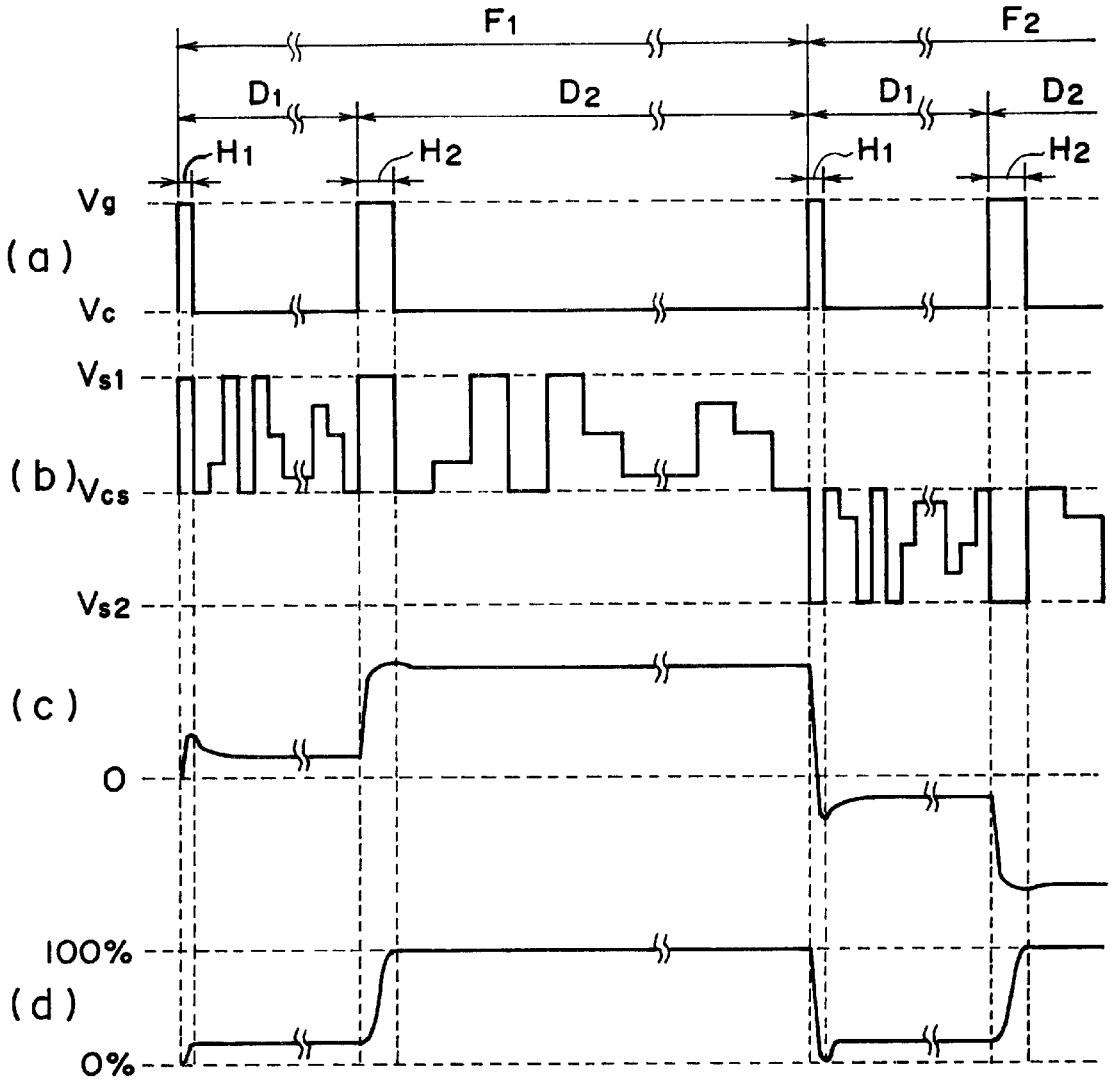
FIGS. 4, 10 and 11 are respectively a time-serial waveform diagram for illustrating an embodiment of the driving method according to the invention.

FIG. 4 is a time-serial waveform diagram for illustrating First embodiment of the driving method, and shows a scanning signal and a data signal applied to a scanning signal line G1 and a data signal line S1, respectively, connected to one pixel electrode 15 in FIG. 1, a voltage applied to the liquid crystal at the pixel, and a transmittance at the pixel, in time series. More specifically, in FIG. 4, at (a) is shown a scanning signal applied to the scanning signal line G1 wherein Vc denotes a reference potential and Vg denotes a potential given to the scanning signal line in a selection period. At (b) is shown a data signal applied to the data signal line S1, which assumes potentials between Vs1 and Vs2 with reference to a common electrode potential Vcs. At (c) is shown a voltage applied to the liquid crystal at the pixel, and at (d) is shown a transmittance of the liquid crystal at the pixel based on a scale between 0% taken at a desired darkest state and 100% taken at a desired brightest state, respectively, of the liquid crystal device. Incidentally, appropriate two transmittance levels of a liquid crystal device may be taken as the desired darkest state and the desired brightest state of the liquid crystal device if such two transmittance levels can be appropriately realized in the liquid crystal device. In this example, the very darkest state and the very brightest state of the liquid crystal device are taken at 0% and 100%, respectively. The liquid crystal device is driven by a succession of frame periods F1, F2, . . . One picture frame display is designed to be completed within each frame period. Each of the frame periods, F1, F2, . . . is divided into a plurality (n) of sub-frame periods D1 and D2 (i.e., n=2 in this example), of which D1 is a preceding sub-frame period and D2 is a final sub-frame period. In the sub-frame periods D1 and D2, a selection period H1 and a selection period H2 are respectively included for selecting the same scanning signal line G1.

In this embodiment, the liquid crystal device is driven according to a frame inversion mode wherein the liquid crystal at the respective pixels is supplied with voltages of which the polarity is inverted frame by frame.

In the driving method according to the present invention, the liquid crystal is supplied with an effectively lower voltage in preceding at least one (=n−1) sub-frame period among a plurality (n) of sub-frame periods than in the final sub-frame period. In other words, as some time is required for charging the liquid crystal having an electrical capacitance (C) at each pixel, a voltage effectively applied to the liquid crystal at the pixel becomes lower than a voltage applied to the electrodes sandwiching the liquid crystal at the pixel when the voltage is applied in a short pulse. The effective voltage applied to the liquid crystal can be further lowered by the responsiveness of an active element for supplying a voltage to the pixel. Accordingly, the response of the liquid crystal at the pixel is not completed in the preceding sub-frame period(s) D1. More specifically, the length of the preceding (n−1) sub-frame period(s) or the selection period therein may be determined so that the response of the liquid crystal at each pixel is not completed within the preceding sub-frame periods in view of the responsiveness of the liquid crystal and the active element while applying an identical (absolute value of) voltage to the data signal line connected to the pixel noted in the plurality (n) of sub-frame periods with each frame period. Thus, the liquid crystal at each pixel is supplied with a lower effective voltage in the preceding (n−1) sub-frame periods than in the final sub-frame period.

According to the above-described embodiment, the following effects are attained.

(1) The sharpness of a motion picture is improved by disposing a low-luminance sub-frame period D1 (comparable to a pause period) within each picture display period (F1).

(2) The increase in transmittance of the liquid crystal at a pixel is accelerated by disposing a short pulse application period (H1) preceding a substantial picture display period (D2) to utilize a liquid crystal drive characteristic that a quicker liquid crystal response can be realized by applying a plurality of divided short pulses than by applying a single pulse of long duration.

The above embodiment has been described based on a liquid crystal device showing a (full) V-character resonsiveness of FIG. 3 (i.e., showing an identical transmittance change in response to application of both positive and negative voltages) but can also be effectively applied to a liquid crystal device showing a so-called half V-character responsiveness that a moderate voltage-transmittance curve allowing a gradational display is attained in response to application of varying voltages of one polarity (e.g., positive) whereas almost no transmittance change is caused but an opaque state is retained in response to application of varying voltages of the other polarity (e.g., negative).

In the above embodiment using a liquid crystal having spontaneous polarization, the liquid crystal state giving a luminance as shown at (d) of FIG. 4 in the preceding sub-frame period(s) D1 contribute to an entire gradational level displayed at the pixel concerned. However, in case where a liquid crystal having no spontaneous polarization is used and a sufficient charge can be injected into the liquid crystal within a selection period of the final sub-frame period, the entire gradational level at the pixel can be determined only based on the final sub-frame period.

In the driving method according to the present invention, the final sub-frame period (α) principally in charge of positive display is set to be substantially longer than a total (β) of the preceding at least one sub-frame period(s). As a result, the problem of signal transmission delay along drive electrodes can be minimized.

For the above reason, the final sub-frame period (α) should preferably be set to at least 1.5 times, more preferably, ca. 2 to ca. 3 times, the total (β) of the preceding sub-frame period(s). If α/β is close to 1, the signal transmission delay can be problematic. If β is too short, it becomes difficult to improve the sharpness of motion picture display.

To supplement the description of the above embodiment shown in FIG. 4, data signals having an identical voltage (Vs1 in FIG. 4) are applied to the pixel electrode of a pixel concerned at selection periods H1 and H2 in the respective sub-frame periods D1 and D2, respectively, for each frame period. Further, in this embodiment, within a preceding sub-frame period D1 including only a short short selection period H1 of one frame period F1, F2, . . . (hereinafter called a "current frame", e.g., F2), the liquid crystal does not complete a response to a voltage (Vs2 - Vcs) expected to be applied between the pixel electrode and the common electrode at the pixel. As a result, in the sub-frame period D1 of the current frame (F2), the liquid crystal is supplied with a voltage which is intermediate a voltage (Vs1 - Vcs) applied to the liquid crystal in a final sub-frame period (D2) of a previous frame (F1) and a voltage (Vs2 - Vcs) applied to the liquid crystal for providing an objective transmittance in the current frame (F2). As a result, the liquid crystal in the sub-frame period (D1/F2) assumes an intermediate state and exhibits a transmittance (at FIG. 4(*d*) for D1/F2) which is much lower than an objective transmittance (happen to be 100% as shown at FIG. 4(*d*) for D2/F2 identical to 100% for D2/F1 in the previous frame). Thus, the preceding sub-frame period D1 exhibits a low transmittance virtually recognized as a non-visible state thus functioning as a substantially non-display period. Then, the liquid crystal at the pixel is supplied with a voltage (Vs2 - Vcs) corresponding to the prescribed display data in a selection period (H2/F2) having a sufficient length in a sub-frame period D2 of the current frame (F2) to complete its response to provide the objective transmittance (100% at FIG. 4(*d*) for D2/F2). Incidentally, in this embodiment, a selection period H1, H2, . . . is placed at the very beginning of each sub-frame period but can be placed to start some time after the beginning of each sub-frame period.

Figure 5A:
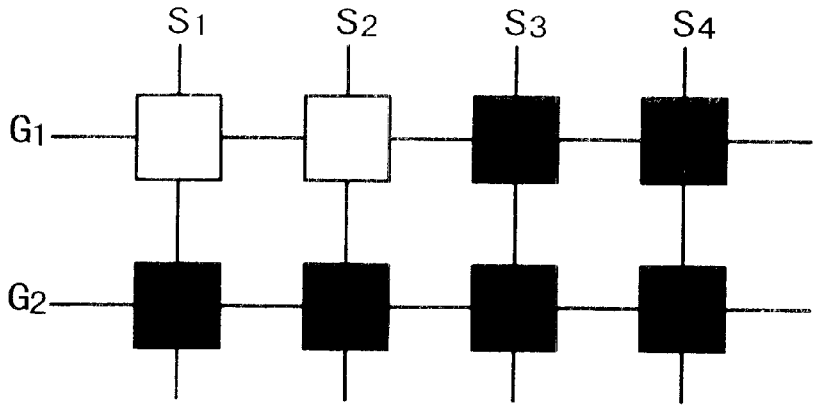
FIGS. 5A–5C illustrate time-serial display state changes at some pixels according to the driving method of FIG. 4.
Figure 5B:
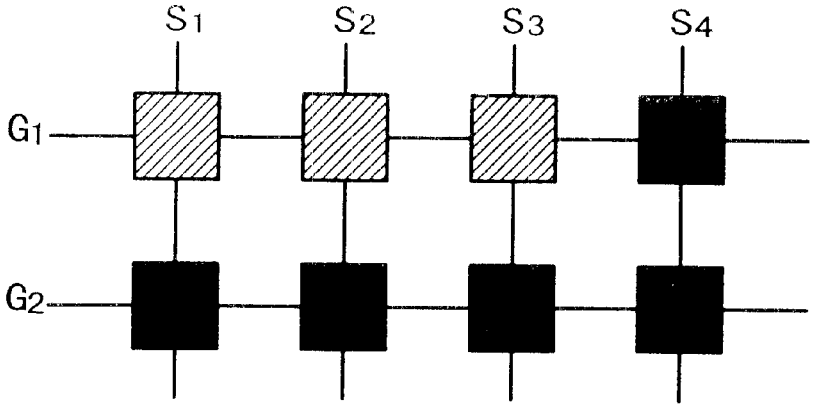
Figure 5C:
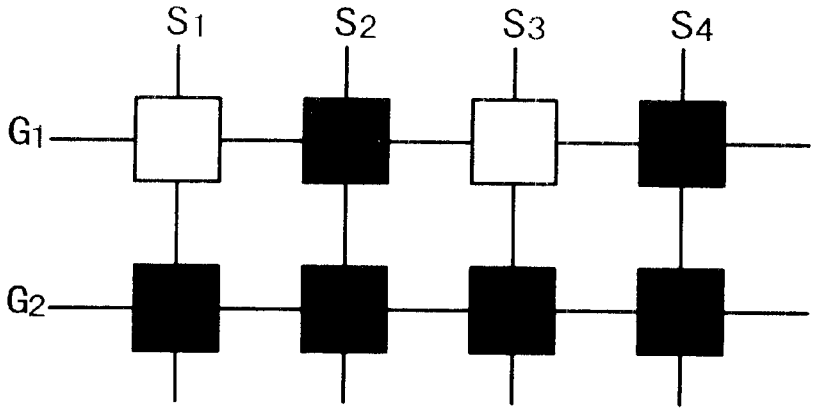
Figure 6:
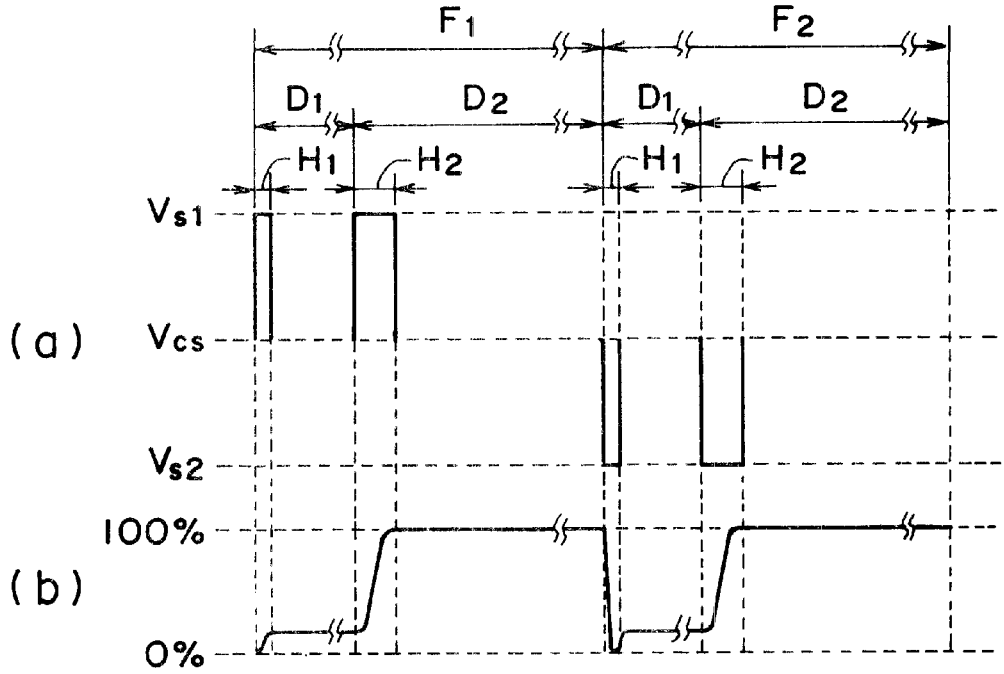
FIGS. 6–9 are time-serial waveform diagrams corresponding to display state changes shown in FIGS. 5A–5C at pixels G1–S1, G1–S2, G1–S3 and G1–S4, respectively.
Figure 7:
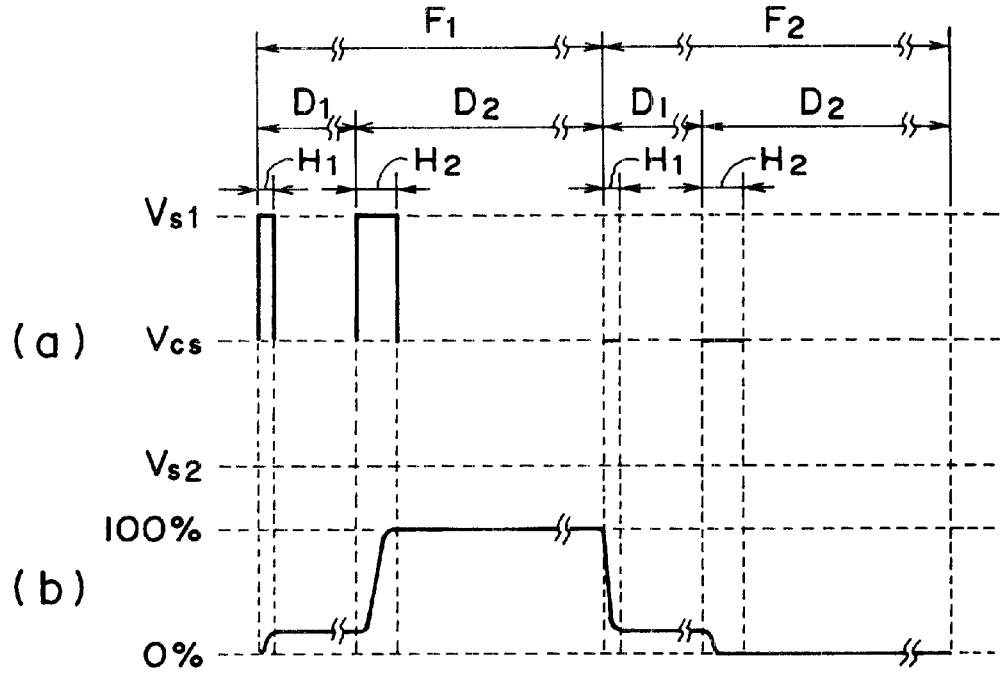
Figure 8:
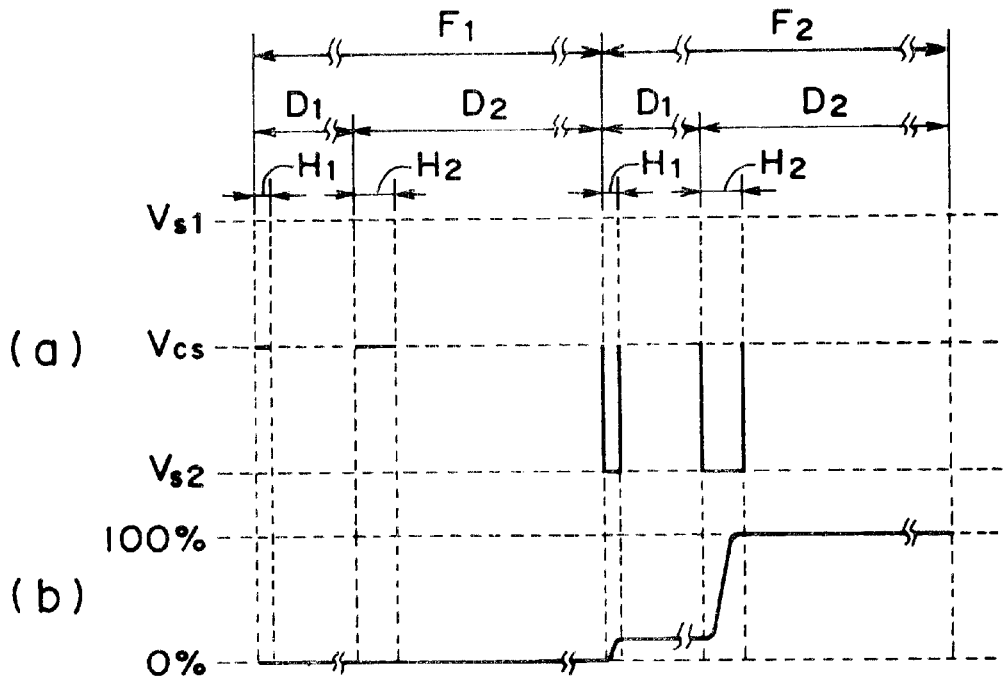
Figure 9:
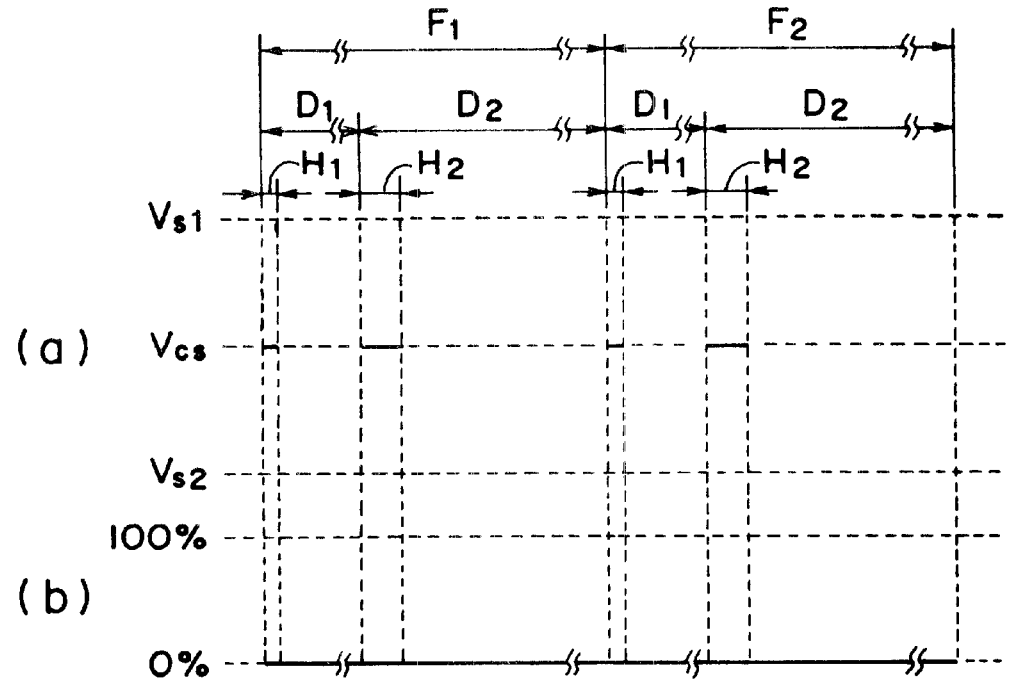

FIGS. 5A–5C illustrate a change arranged pixel states involved in a motion picture display, and FIGS. 6–9 show a set of time-serial waveform diagrams each comparable to FIG. 4 and designed or causing pixel state changes at pixels G1–S1, G1–S2, G1–S3 and G1–S4, respectively, of FIGS. 5A–5C. FIG. 5A represents a display state in a sub-frame period D2 in a frame period F1 (denoted by D2/F1), FIG. 5C represents a display state in a sub-frame period D2/F2, and FIG. 5B represents a substantially non-display state in a sub-frame period D1/F2. In FIGS. 6–9, at (a) are shown data signals while omitting data signals for pixels not contemplated therein for convenience, and at (b) are shown transmittance changes at the pixels concerned.

As is understood from FIGS. 5–9, at the time of pixel state change from "white (W)" to "black (B)" or B to W, accompanying a picture movement, intermediate pixel states (as shown at G1–S1 and G1–S3) based on intermediate potentials are inserted during the state change. Such an intermediate display state is inserted between frames also in the case of continuous display of W—W as shown at G1–S1 in FIG. 5B between FIGS. 5A and 5C. However, in the case of continuous display of B—B, no display state is inserted based on an intermediate potential, so that any deterioration of contrast is not caused.

In the driving method of the present invention, by effecting an intermediate potential display (pre-charge) by dividing one frame into a plurality of sub-frames, the motion picture quality can be improved. Further, by setting an actual display period (i.e., sub-frame period D2) to be longer than a non-display period (i.e., sub-frame period D1), the lowering in contrast of a picture during the non-display period can be visually minimized, and the problem of signal transmission delay along the panel electrodes can also be suppressed. In the above embodiment, the selection periods H1 and H2 for the preceding sub-frame period and the final sub-frame period can be set at arbitrary values and arbitrary time in respective sub-frame period within an extent of H1<H2.

Second embodiment

Figure 10:
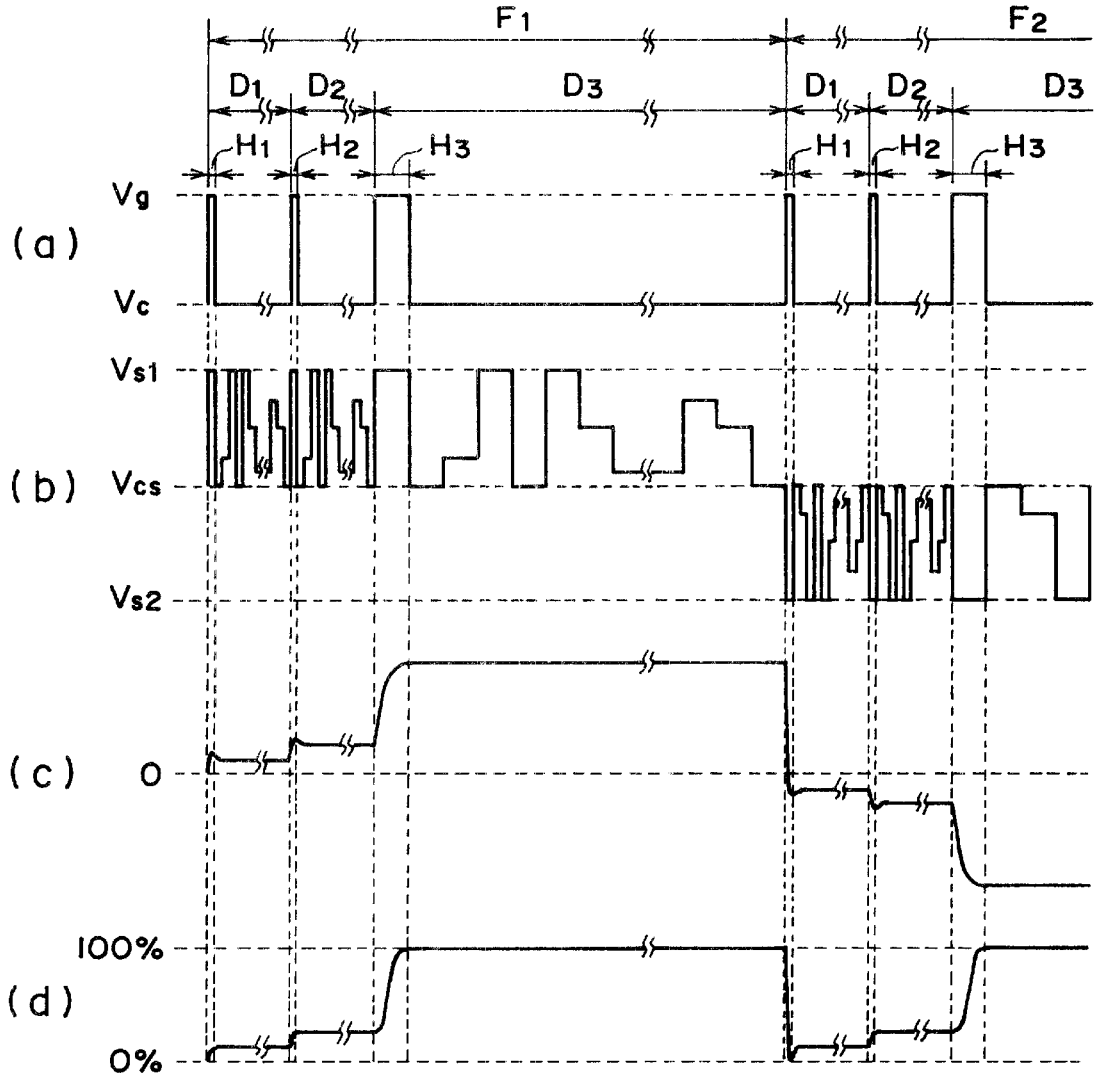

FIG. 10 is a time-serial waveform diagram for illustrating Second embodiment of the driving method according to the present invention. Referring to FIG. 10, F1, F2, . . . each represent one frame period for displaying one frame picture data; D1–D3 represent sub-frame periods formed by dividing one frame period; and H1–H3 represent selection periods set during the sub-frame periods D1–D3, respectively. In FIG. 10 (similarly as in FIG. 4), at (a) is shown a scanning signal applied to a scanning signal line G1 in FIG. 1 wherein Vc denotes a reference potential and Vg denotes a potential given to the scanning signal line in a selection period. At (b) is shown a data signal applied to a data signal line S1, which assumes potentials between Vs1 and Vs2 with reference to a common electrode potential Vcs. At (c) is shown a voltage applied to the liquid crystal at a pixel G1–S1, and at (d) is shown a transmittance of the liquid crystal at the pixel based on a scale between 0% taken at the darkest state and 100% taken at the brightest state, respectively, of the liquid crystal device.

This embodiment is similar to First embodiment except that each of frame periods F1, F2, . . . is divided into three sub-frame periods D1–D3. By increasing the number of sub-frame periods in this manner, the transmittance change becomes more continuous through a larger number of intermediate states at the time of pixel state change, thus providing a smoother motion picture quality.

Third embodiment

Figure 11:
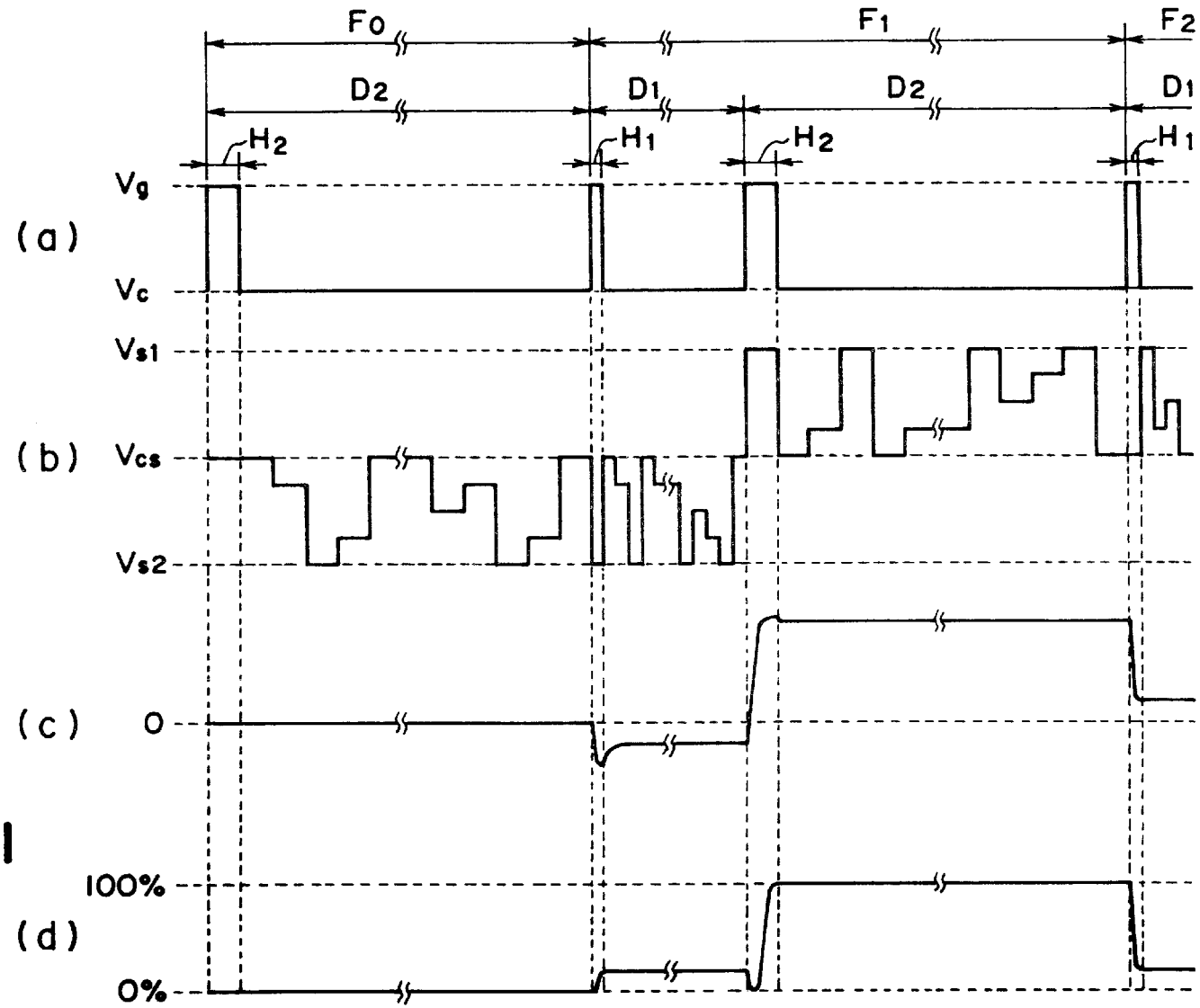

FIG. 11 is a time-serial waveform diagram for illustrating Third embodiment of the driving method according to the present invention. Referring to FIG. 11, F0, F1, F2, . . . each represent one frame period for displaying one frame picture data; D1 and D2 represent sub-frame periods formed by dividing one frame period; and H1 and H2 represent selection periods set during the sub-frame periods D1 and D2, respectively. In FIG. 11 (similarly as in FIG. 4), at (a) is shown a scanning signal applied to a scanning signal line G1 in FIG. 1 wherein Vc denotes a reference potential and Vg denotes a potential given to the scanning signal line in a selection period. At (b) is shown a data signal applied to a data signal line S1, which assumes potentials between Vs1 and Vs2 with reference to a common electrode potential Vcs. At (c) is shown a voltage applied to the liquid crystal at a pixel G1–S1, and at (d) is shown a transmittance of the liquid crystal at the pixel based on a scale between 0% taken at the darkest state and 100% taken at the brightest state, respectively, of the liquid crystal device.

This embodiment is similar to First embodiment in that it adopts a frame inversion drive mode and one frame period is divided into two sub-frame periods but is different from First embodiment in that the frame polarity inversion is effected at the beginning of a final sub-frame period. Thus, the voltage polarity applied to the liquid crystal in a final sub-frame period of an m-th frame period is set to be identical to the voltage polarity applied in preceding sub-frame period(s) of an (m+1)th frame period.

More specifically, the polarity of a voltage applied to the liquid crystal at each pixel at a selection period H1 in a sub-frame period D1 of a frame period F1 is identical to the polarity of a voltage applied to the liquid crystal at the pixel at a selection period H2 in a sub-frame period D2 of a previous frame period F0. Further, the absolute value of voltage applied to a data signal line connected to each pixel (relative to the potential of the common electrode) at H1 in D1 is made identical to the absolute value of voltage applied to the data signal line connected to the pixel (relative to the potential of the common electrode) at H2 in D2.

Figure 12A:
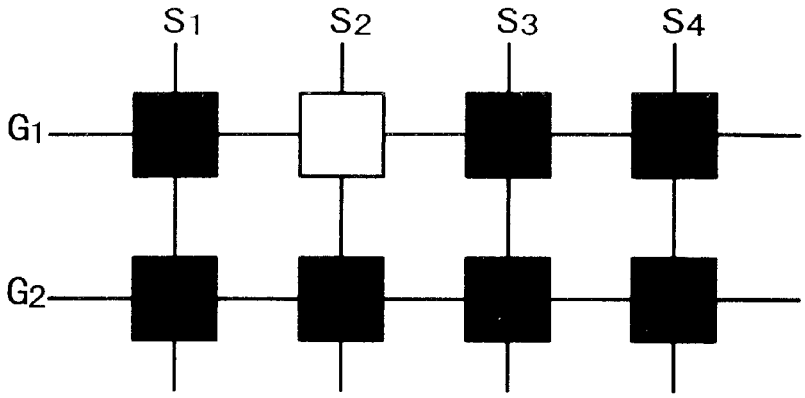
FIGS. 12A–12C illustrate time-serial display state changes at some pixels according to the driving method of FIG. 11.
Figure 12B:
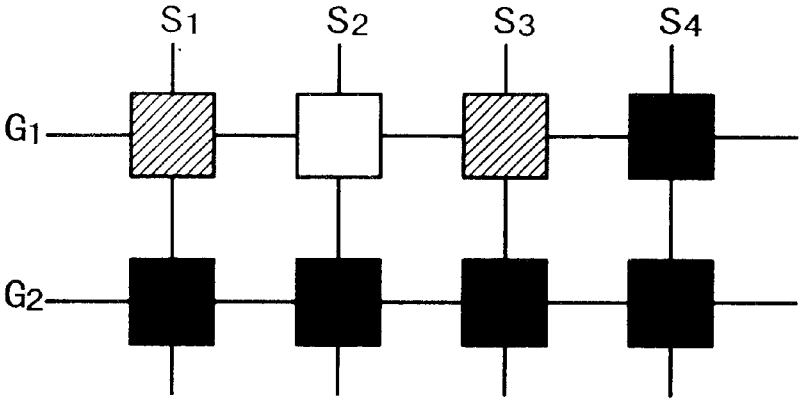
Figure 12C:
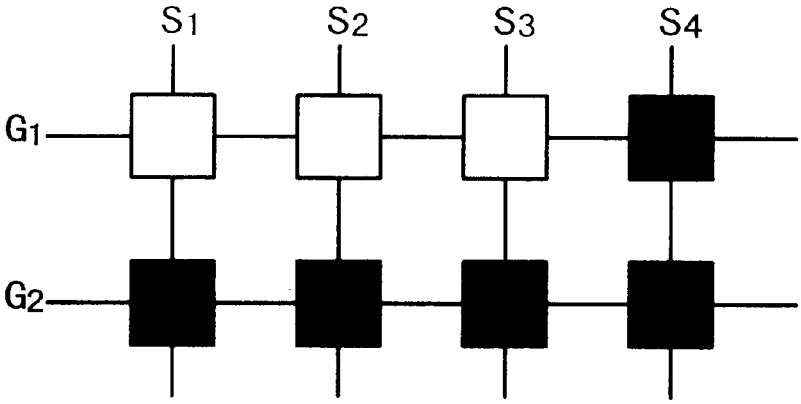

FIGS. 12A, 12B and 12C show an example of pixel stage changes including states in sub-frame periods D2/F0, D1/F1 and D2/F1, respectively.

By shifting the time of frame polarity inversion, an intermediate potential display is inserted only when a pixel state change is caused at each pixel, and such an intermediate potential display is not inserted when white (W) or black (B) is continually displayed, whereby better display in respects of both contrast and luminance becomes possible.

Examples

A liquid crystal device (panel) having an organization shown in FIGS. 1 and 2 and showing a V-character-shaped responsiveness shown in FIG. 3 was prepared and driven according to the driving methods illustrated in FIGS. 4, 10 and 11 respectively.

The liquid crystal device included 120×160 pixels and a TAFLC showing a spontaneous polarization of $150\times10^{9}$ C/cm$^2$ at 30° C., a tilt angle of 30 deg. from the rubbing direction and a dielectric constant of 5. Each pixel had an effective display area (opposing area of a pixel electrode and a common electrode) of $2.0\times10^{8}$ m$^2$, a retention capacitance of 0.25 pF and a TFT having an on-resistance of 10 M.ohm.

In the driving method of FIG. 4, the parameters were set as follows:

F1=F2= . . . =16.8 msec, D1=4.8 msec,

D2=12 msec, H1=40 μsec, H2=100 μsec,

Vc=0 volt, Vg=25 volts, Vcs=10 volts,

Vs1=16 volts, Vs2=4 volts.

It was confirmed that a motion picture display was performed under the above conditions with no irregularity over the panel and with good motion picture quality.

In the driving method of FIG. 10, the parameters were set as follows:

F1=F2= . . . =16.8 msec, D1=D2=2.4 msec,

D3=12 msec, H1=H2=20 μsec, H3=100 μsec.

The potential values (Vc, etc.) were set equal to those in the method of FIG. 4.

As a result, a motion picture display was performed with no irregularity over the panel and with good motion picture quality with better smoothness.

In the driving method of FIG. 11, the parameters were set as follows:

F0=F1=F2= . . . =16.8 msec, D1=4.8 msec,

D2=12 msec, H1=40 μsec, H2=100 μsec.

The potential values were set equal to those in the method of FIG. 4.

As a result, a motion picture display was performed with no irregularity over the panel, better contrast and luminance, and improved motion picture quality.

As described above, according to the present invention, a motion picture display can be performed with an improved motion picture display according to an approximately non-hold type display by effecting an intermediate potential display in a preceding sub-frame period, while obviating a lowering in display luminance or contrast and also without causing display irregularity due to signal transmission delay along conductors. Accordingly, it becomes possible to utilize a liquid crystal device as a motion picture display device, such as a television receiver.

What is claimed is:

1. A driving method for a liquid crystal device of the type comprising: a pair of substrates, a liquid crystal disposed between the substrates so as to form a matrix of pixels arranged in a plurality of rows and a plurality of columns, an electrode matrix for applying voltages to the liquid crystal at respective pixels, and a plurality of active elements each provided to a pixel for supplying a voltage applied to the liquid crystal at the pixel; the driving method comprising driving the liquid crystal device in a succession of frame periods, wherein each frame period is divided into a plurality of sub-frame periods including at least one preceding sub-frame period and a final sub-frame period so that said at least one preceding sub-frame period provides a total period which is shorter than the final sub-frame period, the active elements along the rows of pixels are sequentially selected row by row at respective selection periods in each sub-frame period, and the liquid crystal at each pixel is supplied with a voltage in each preceding sub-frame period which is lower than a voltage applied to the liquid crystal at the pixel in the final sub-frame period.

2. A driving method according to claim 1, wherein the liquid crystal at each pixel is supplied with a voltage of a polarity which is inverted frame by frame.

3. A driving method according to claim 2, wherein the liquid crystal at each pixel receives an identical polarity of voltage in the final sub-frame period of a previous frame period and in the preceding sub-frame period of a current frame period.

4. A driving method according to claim 1, wherein each frame period is divided into two sub-frame periods.

5. A driving method according to claim 1, wherein the liquid crystal is a chiral smectic liquid crystal having a spontaneous polarization.

6. A driving method according to claim 1, wherein the liquid crystal shows a V-character voltage-transmittance responsiveness.

7. A driving method according to claim 1, wherein the liquid crystal at each pixel responds to an applied voltage completely in one frame period.

8. A driving method for a liquid crystal device of the type comprising:

a pair of substrates, a liquid crystal disposed between the substrates so as to form a matrix of pixels arranged in a plurality of rows and a plurality of columns, an electrode matrix for applying voltages to the liquid crystal at respective pixels, and a plurality of active elements each provided to a pixel for supplying a voltage applied to the liquid crystal at the pixel;

the driving method comprising driving the liquid crystal device in a succession of frame periods each designed for displaying one picture frame data, wherein each frame period is divided into a plurality of sub-frame periods including at least one preceding sub-frame period and a final sub-frame period so that said at least one preceding sub-frame period provides a total period which is shorter than the final sub-frame period, the active elements along the rows of pixels are sequentially selected row by row at respective selection periods in each sub-frame period so that a total of the selection period(s) for an active element at each pixel in said at least one preceding sub-frame period is shorter than the selection period for the active element at the pixel in the final sub-frame period, and the liquid crystal at each pixel is sandwiched between a pair of electrodes formed on the pair of substrates, and the liquid crystal is supplied with a voltage in the one or more preceding sub-frame period, which voltage is lower than a voltage applied to the pair of electrodes in the selection period(s) of the one or more preceding sub-frame period in each frame period.

9. A driving method according to claim 8, wherein a voltage of one polarity is applied in the final sub-frame period of a previous frame period and a voltage of the other polarity is applied in the final sub-frame period of a current frame period, respectively, between the pair of electrodes at each pixel.

10. A driving method according to claim 9, wherein the liquid crystal at each pixel receives an identical polarity of voltage in the final sub-frame period of a previous frame period and in the preceding sub-frame period of a current frame period.

11. A driving method according to claim 8, wherein each frame period is divided into two sub-frame periods.

12. A driving method according to claim 8, wherein the liquid crystal is a chiral smectic liquid crystal having a spontaneous polarization.

13. A driving method according to claim 8, wherein the liquid crystal shows a V-character voltage-transmittance responsiveness.

14. A driving method according to claim 8, wherein the liquid crystal at each pixel responds to an applied voltage completely in one frame period.

* * * * *

UNITED STATES PATENT AND TRADEMARK OFFICE

CERTIFICATE OF CORRECTION

PATENT NO. : 6,473,117 B1
DATED : October 29, 2002
INVENTOR(S) : Jun Iba

It is certified that error appears in the above-identified patent and that said Letters Patent is hereby corrected as shown below:

Column 3,
Line 8, “liens” should read -- lines --;
Line 32, “ordinary” should read -- ordinarily --;
Line 42, “($SiN^x$),” should read -- ($SiN_x$), --; and
Line 43, “dlain” should read -- drain --.

Column 4,
Line 25, “correspond” should read -- corresponds --.

Column 6,
Line 33, “intermediate a voltage” should read -- intermediate to a voltage --;
Line 40, “(happen” should read -- (which happens --; and
Line 55, “a change arranged pixel states involved” should read -- time-serial display state changes at some pixels --.

Column 7,
Line 60, “represent” should read -- represents --.

Column 10,
Line 33, “one” should read -- at least one --;
Line 34, “or more” should be deleted; and
Line 36, “period(s) of the one or more preceding” should read -- period of the final --.

Signed and Sealed this

Eighth Day of July, 2003

JAMES E. ROGAN
*Director of the United States Patent and Trademark Office*